United States Patent [19]

Tomma et al.

[11] Patent Number: 4,746,076

[45] Date of Patent: May 24, 1988

[54] WINDER DEVICE

[75] Inventors: Kauko Tomma, Helsinki; Seppo Saukkonen, Vantaa, both of Finland

[73] Assignee: Oy Wärtsilä Ab, Helsinki, Finland

[21] Appl. No.: 927,261

[22] Filed: Nov. 4, 1986

[30] Foreign Application Priority Data

Nov. 20, 1985 [FI] Finland ..... 854571

[51] Int. Cl.[4] ..... B65H 16/10; B65H 18/16

[52] U.S. Cl. ..... 242/66; 242/68.7

[58] Field of Search ..... 242/66, 68.7, 56 R, 242/65, 67.1, 67.2, 78.7

[56] References Cited

U.S. PATENT DOCUMENTS 4,465,243 8/1984 Welp ..... 246/66

FOREIGN PATENT DOCUMENTS 2908294 9/1980 Fed. Rep. of Germany .

417769 11/1934 United Kingdom .

*Primary Examiner*—John M. Jillions
*Assistant Examiner*—Steven M. Dubois
*Attorney, Agent, or Firm*—Dellett, Smith-Hill and Bedell

[57] ABSTRACT

In a winder device for winding a moving web, such as paper or cardboard web, to form a roll of considerable weight, the roll is carried by support members giving it peripheral support. The support members comprise a rotatable winder drum, transmitting the web to the roll, and a movable support web device. The support members are arranged to form the main support of the roll. The support web device includes a support web having a portion between two rotatable support elements and this support web portion has a roll supporting surface of contact with the roll. The surface of contact is continuously enlarged when said roll grows, in order to eliminate the risk of roll damages due to excess support pressure when winding heavy rolls.

23 Claims, 5 Drawing Sheets

Figure 1:
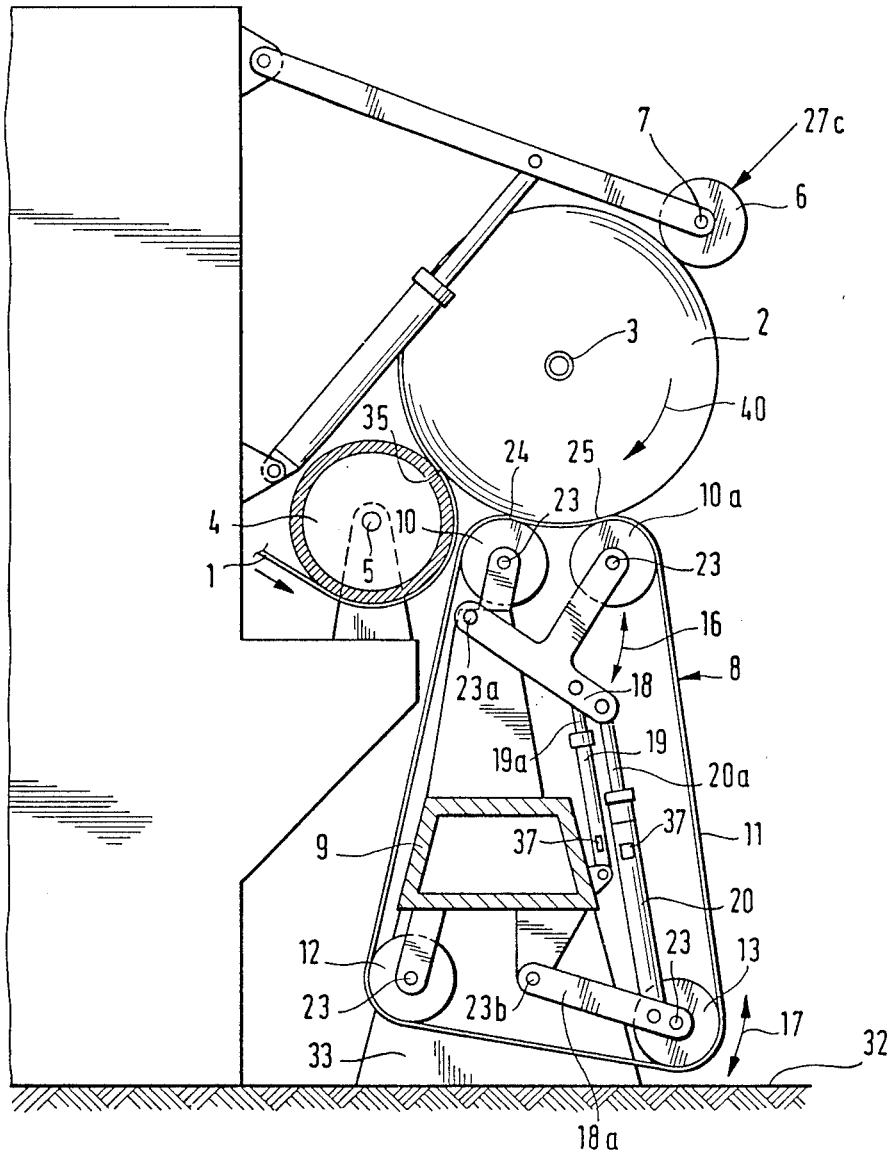

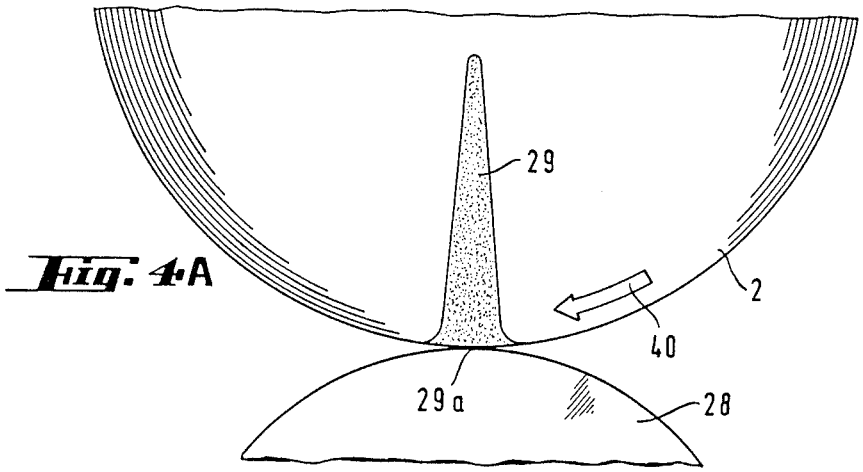
Fig. 4A
Fig. 4B
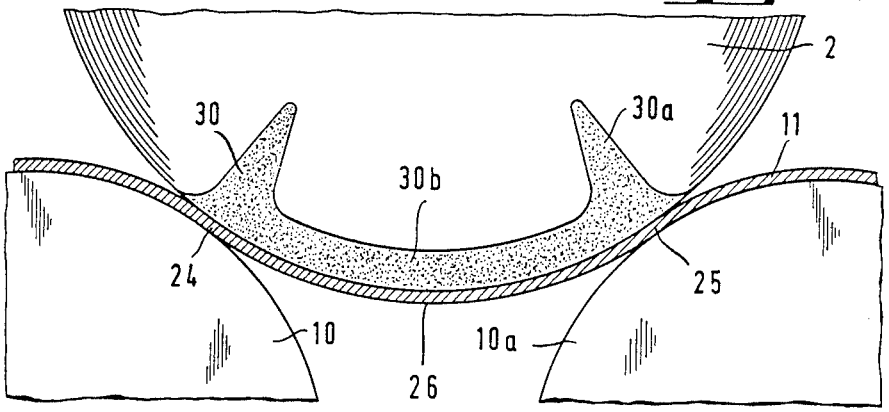
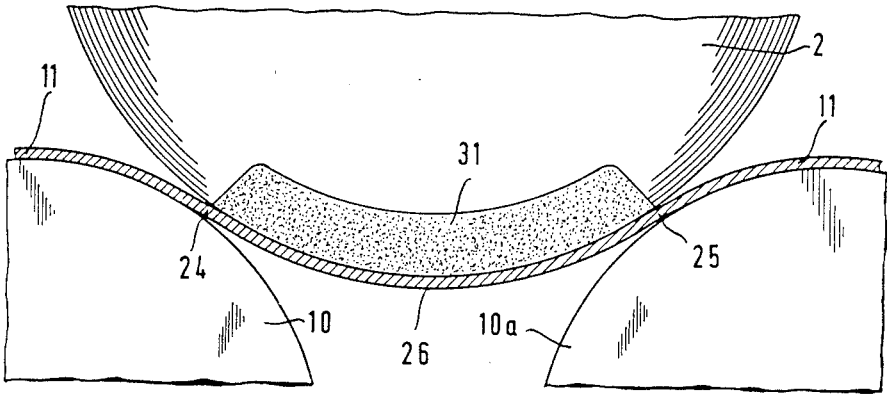
Fig. 4C

WINDER DEVICE

The invention relates to a winder device. Typical for modern winders of this kind is that paper webs are wound at a web running speed of more than 2000 m/min.

When winding paper rolls supported mainly by peripheral support, the support forces provide load peaks generating internal damage in heavy rolls. Typical damages are wrinkles and web fractures. The damage is caused mainly by high support pressure occurring in the nip between the wound roll and its support drum or drums. The support pressure is caused by the roll's own weight and by the load of the rider roll, if such a roll is used. A paper roll spoiled by damage causes considerable trouble when used, for instance, in a printing press. Frequently, damaged rolls are not at all accepted by the customers.

Relevant prior art is disclosed, for instance, in U.S. Pat. Nos. 4,485,980, 4,485,979 and 4,456,190. In order to create a roll of good quality in a support drum winder, the line or nip pressure between the roll and its support drum should be at least about 1 . . . 4 kN/m, depending on the paper grade to be wound.

If a small-sized support drum is used, the nip pressure tolerated by the roll will be exceeded, in particular during the final phase of winding a big roll. This is because a small support drum provides a very narrow support area giving a high contact pressure at a given roll weight. Further, local pressure peaks may occur due to uneven paper web thickness in the web transverse direction. Attempts have been made to reduce the support pressure by increasing the dimension of the support drum, but this measure increases the manufacturing costs and operational expenses due to the increased inertia of the drum. Thus, an increase of the drum diameter is profitable only up to a certain limit. This limit has already been reached in conventional support drum winders.

A support drum generates, in the supported roll, radial depressions and sometimes also circumferential dislocations of the roll layers. This may cause ruptures and wrinkles in the web. Decreased nip pressure reduces the generation of nip pressure dependent roll defects. Patent Specification EP No. 157062, corresponding to U.S. patent application Ser. No. 529512 of 1983, discloses a soft-surface support drum. Such a drum decreases the nip pressure, but gives rise to dynamic shaping problems because two yielding surfaces are brought together in a nip, which results in stability problems and heat generation.

Attempts to reduce the support pressure by using two support drums have been made. An arrangement of this kind is shown in Patent Specification DE No. 3121039. The use of two support drums makes it possible to control individually the support pressure at each of the drums. The most uniform division of the support pressure is obtained by using support drums of equal diameter symmetrically arranged below the suported roll, as shown in U.S. Pat. No. 4,456,190. U.S. Pat. No. 3,098,619 teaches the use of an extended nip construction by means of a belt member, but the nip extension in the circumferential direction of the paper roll is kept constant, which means that the paper roll is carried by the same support surface irrespective of the roll size. This technique thus gives practically the same result as the use of symmetrically arranged twin support drums.

In both cases the support pressure increases to an often far too high value when the wound roll grows, or the winding has to be stopped before the roll has become too heavy.

The weight of a paper roll may also entirely or partially be taken up by central shaft support means. This makes it possible to effectively control the roll density and the nip pressure throughout the entire winding process, and thus, winding faults caused by excess support nip pressure can to a great extent be eliminated, see Patent Specification GB No. 2142909. However, other problems occur due to the complexity caused by the use of separate supports. U.S. Pat. No. 4,143,828 shows a central shaft support system having also belt support means. This winder is a Pope-type reel-up winder using a rigid central shaft. Practically the entire support load is taken up by the shaft.

The object of the invention is to create a device, in which excess nip pressure caused by increasing roll weight is eliminated while maintaining the advantages of conventional support drum winding. Another object is to create an arrangement, in which the winding nip pressure is easily controllable and the load caused by the roll weight is taken up by a large support surface.

Patent Specification DE No. 2908294 discloses a winder with some features similar to the features of the invention. This known design uses two stationary drums arranged in vertical alignment and a third movable drum, which is operated to carry out several functions: the function of a rider roll, of a support drum and of a control member determining the tension of a support belt. The increasing paper roll diameter determines the position of the movable drum, and this means that the rider roll function of the movable drum is eliminated as the winding process advances. Hence, the entire support picture will change and the paper roll will be supported practically only by the lower one of the stationary drums and by the movable drum. This change is difficult to control accurately, which means that there is a considerable risk of uncontrolled excess nip pressures occurring.

A preferred embodiment of the invention is a winder device for winding a moving web, such as a paper or cardboard web, to form a roll of considerable weight. The roll is carried by support members which give the roll peripheral support. The support members comprise a movable support web device and a rotatable winder drum which is spaced from the support web device about the periphery of the roll. The support members form the main support for the roll. The support web device includes a support web having a portion between two rotatable support elements, which support web portion has a surface of contact with the roll giving the roll support. The surface of contact is continuously enlarged when the roll grows, in order to eliminate the risk of roll damage due to excess support pressure when winding heavy rolls. The web is conducted to the roll about the periphery of the winder drum and through the space between the winder drum and the support web device. The hardness of a wound roll is determined by the nip pressure which is dependent on the roll weight. These factors are controlled by determining the relative position of the paper roll, the winder drum and the other support members. If a rider roll is used, its load is accurately controlled as well. The advantages of a conventional support drum winder are achieved by keeping the paper roll at or above the level of the center of the winder drum.

The supporting properties of the support web are adjusted by controlling the web tension and the relative position of the web support drums. The supporting portion of the support web extends during a phase of the winding from a nip between the paper roll and the first support drum towards the other support drum. Thereafter, during another winding phase, the support portion of the web extends into or very close to both nips between the roll and the support drums, thereby supporting a big roll over a considerable portion of its circumference.

The distribution of the support forces can also be adjusted by altering, in relation to the increase in roll diameter, the position of the nip between the roll and the winder drum. The support force distribution is also influenced because the loading direction of the rider roll, alters relatively to the drums of the winder because of the increasing diameter of the paper roll.

In order to obtain the most favourable winding result in a device according to the invention, certain geometrical conditions should be fulfilled. The shaft of the winder drum and the shaft of the first support drum define a reference plane and the second support drum is movable relative to this plane. The angle between a line through the center of the support drums and the reference plane should be adjustable 45° upwards from the reference plane and the same angle downwards, or at least 15° downwards. Also the reference plane should be adjustable about ±20° from its normal position. This can be done by adjusting the vertical position of either the winder drum or the first support drum. The diameter of the winder drum should preferably be 3.5 to 1.5 times the diameter of the first support drum.

The support drums and the support web should take up at least half the weight of the roll already at a relatively early stage of the winding. When the roll diameter exceeds 300 mm preferably at least 60% of the support forces, eventually even 80% should be taken up by the web support arrangement. The support forces include the weight of the roll and the vertical load component of the rider roll.

The position of the second support drum and the support web tension are adjusted so, that during an early winding phase the support contact portion of the support web increases continuously. Later, the roll is supported by the winder drum, by the two support drums and by the support web. The tension of the support web will be so adjusted that the roll weight received by the support web between the support drums is at least mainly uniformly distributed. The uniform load distribution should include, in the most favourable alternative, also the nips provided by the two support drums. The support is thus extended over a surface which is at least ten times the nip support surface of a support drum in a conventional support drum winder. By means of this arrangement the nip pressure acting on the roll can be reduced to only about 20%, and sometimes to even less than 10% of the nip pressure in a winder of the kind shown in U.S. Pat. No. 4,456,190. The maximum pressure tolerated by a paper roll is about 4 to 12 times the support pressure in a device according to the invention. Hence, the invention makes it possible to wind considerably bigger and heavier rolls than in conventional winders. In practice, it has been possible to wind rolls with a weight of about 3000 kg per meter axial roll length.

An example of the calculated weight distribution is given in Table 1.

TABLE 1

Density of paper web 1200 kg/m$^3$. Diameter of roll core 100 mm. Maximum diameter of roll 1500 mm. Axial length of roll 1 m. Column headings:
A = roll diameter (mm)
B = roll weight (N)
C = relative support forces as a percentage of the total roll weight, a = support web, b = winder drum;
D = absolute support forces (N), Fa = support web, Fb = winder drum;
E = web tension (N);
kg = kilogram, m = meter, mm = millimeter, N = newton

| | | C | | D | | |
|---|---|---|---|---|---|---|
| A | B | a | b | Fa | Fb | E |
| 100 | core | — | — | — | — | — |
| 300 | 850 | 95 | 40 | 810 | 340 | small |
| 500 | 2400 | 90 | 41 | 2200 | 980 | 2380 |
| 600 | 3400 | 88 | 48 | 2990 | 1630 | 3470 |
| 700 | 4600 | 87 | 41 | 4000 | 2140 | 5020 |
| 800 | 6030 | 87 | 35 | 5250 | 2110 | 7000 |
| 900 | 7600 | 88 | 28 | 6700 | 2150 | 9570 |
| 1100 | 11400 | 89 | 20 | 10200 | 2300 | 16070 |
| 1300 | 16000 | 93 | 12,5 | 15000 | 2000 | 25650 |
| 1500 | 21200 | 96 | 7 | 20000 | 1500 | 37420 |

For rolls of other length than 1 m, the values of columns B, D and E should be multiplied with the roll length in meters.

Figure 2:
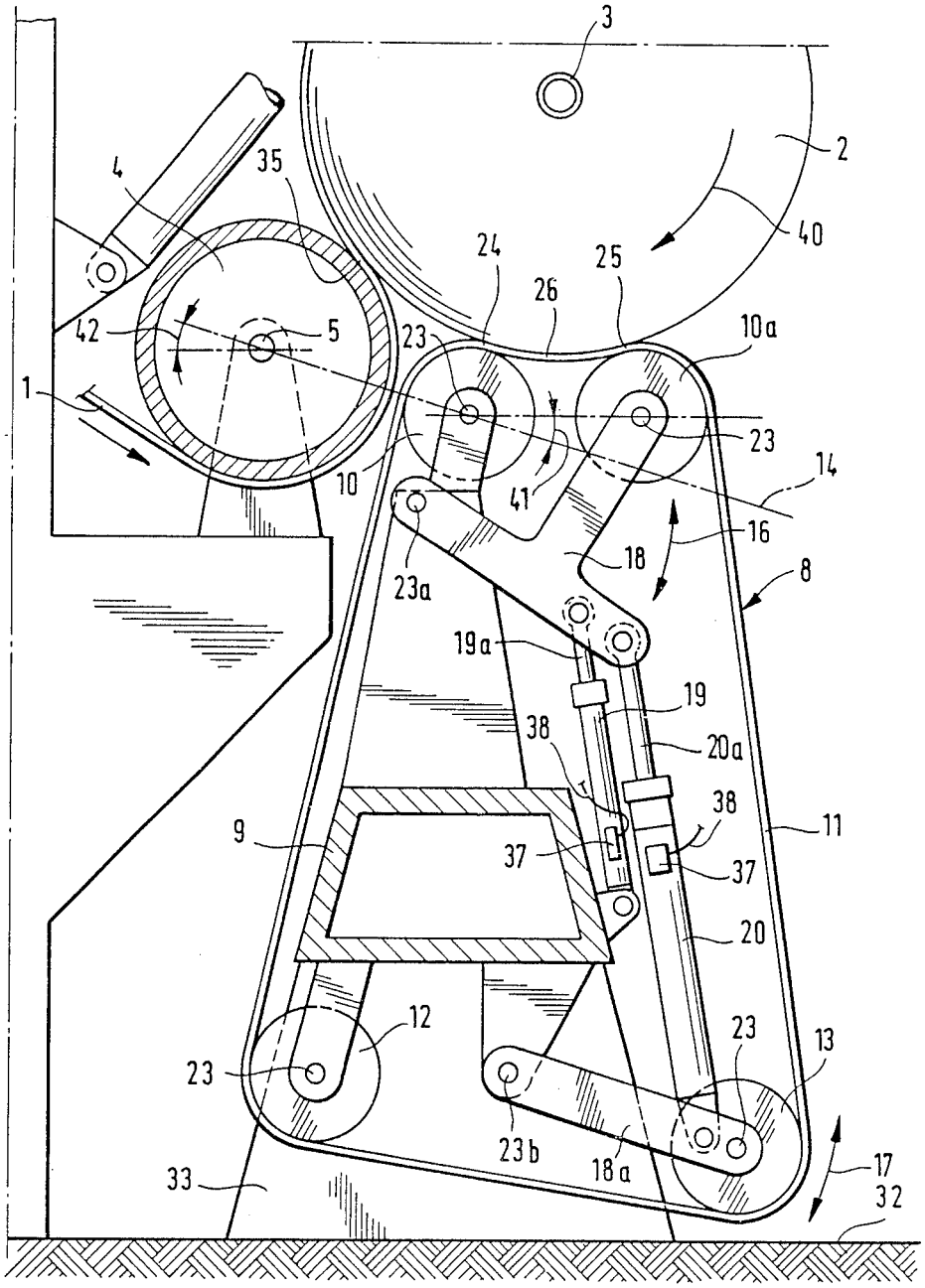
Figure 3A:
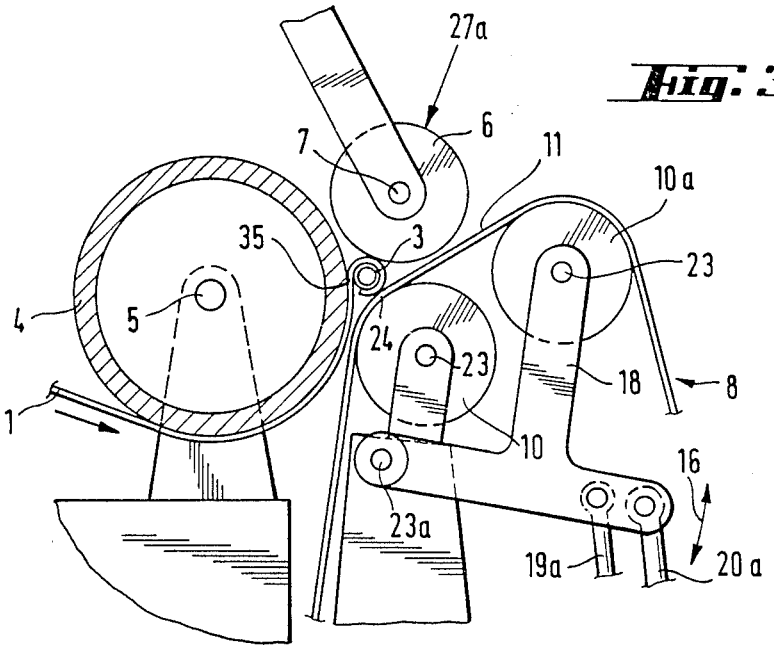
Figure 3B:
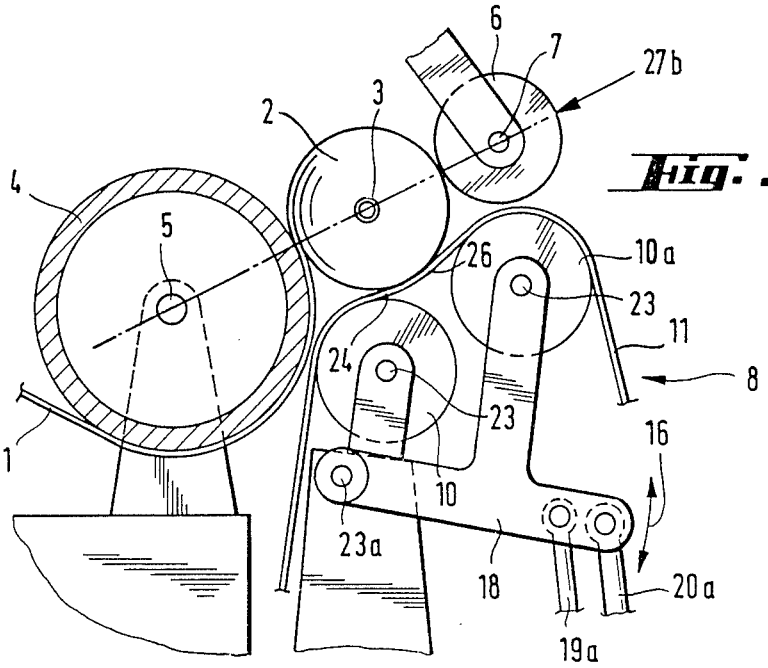
Figure 3C:
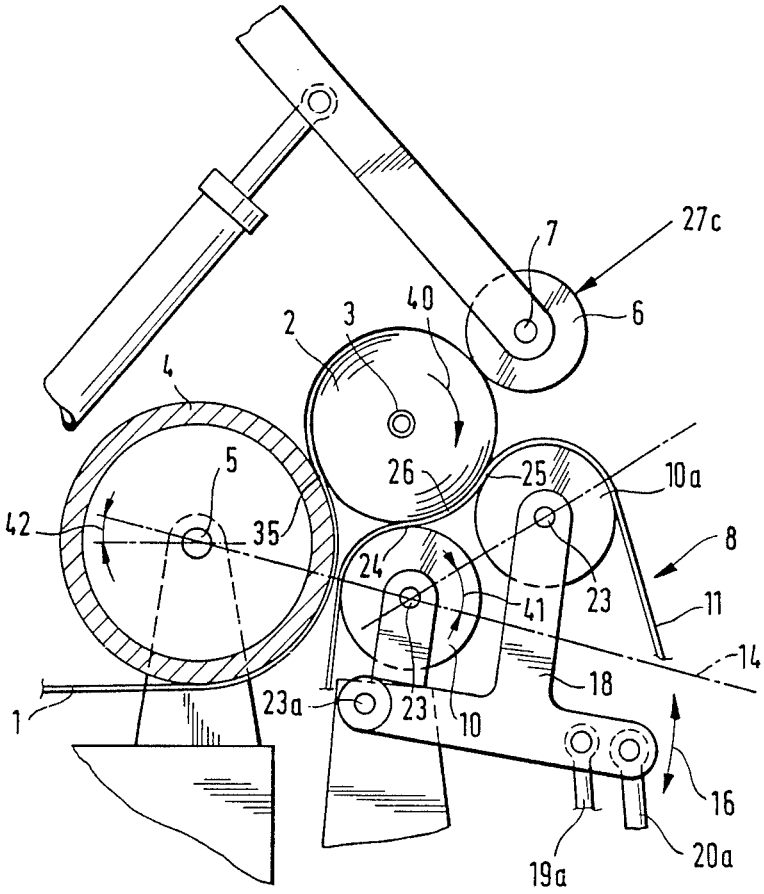

The invention will now be described, by way of example, with reference to the accompanying drawings, in which FIG. 1 is a schematical side view of an embodiment of invention, FIG. 2 is a portion of FIG. 1 shown on a larger scale, FIGS. 3A, 3B and 3C illustrate consecutive winding phases, FIGS. 4A, 4B and 4C visualize the support distribution in a roll in some typical support cases.

A running paper web 1 is wound on a core 3 to form a roll 2. The roll rotates as shown by an arrow 40 and is supported by a winder drum 4 and a support web device 8. The winder drum 4 is rotatably journalled and has a central shaft 5. There is a rotatable rider roll 6 having a central shaft 7.

The support web device 8 comprises a stationary first support drum 10 and a movable second support roll **10*a*, both rotatably journalled at their respective center 23. A support arm 18 turnable around a fixed point 23*a* carries the movable support roll 10*a* adjustable as shown by arrows 16 by turning support arm 18 around its fixed point 23*a*. There is a stationary web guide roll 12 and a movable web tension roll 13, both rotatably supported at their respective center 23. An endless support web 11 runs over the drums 10, 10*a*, 12 and 13. This web or belt may be composed by a number of belts running side by side. Tension drum 13, movable as indicated by arrows 17, is carried by a movable lever 18*a* journalled at a fixed point 23*b*. Winder drum 4 and support drum 10 define a reference plane 14 (FIG. 2**).

There are hydraulic or pneumatic operative members 19, **19*a* and 20, 20*a*. Members 19, 19*a* operate between a fixed frame element 9 and support arm 18 to adjust the position of drum 10*a*. Members 20, 20*a* maintain the web tension by operating between lever 18*a* and support arm 18. The operative members have pressure or force sensors 37, which through connections 38** transmit pressure or force information to a measuring and control device (not shown).

When the roll 2 reaches its maximum diameter, it is supported by three nips 24, 25 and 35. Between nips 24 and 25 support web 11 has a portion 26, which also works as a roll supporting element carrying a considerable portion of the load produced by the weight of roll 2 and by the load of rider roll 6, if any. The load direction of rider roll 6 is indicated by reference numerals 27*a–c*.

In FIG. 3A shows the start of the winding process. The load 27*a* of rider roll 6 is always directed towards the center of the roll 2. During an initial winding phase, winder drum 4 and support drum 10 give support at nips 35 and 24, respectively.

In FIG. 3B roll 2 has become considerably bigger and a portion of its weight is received by support portion 26 of web 11. The roll 2 presses web portion 26 downwards. The tension of support web 11 is adjusted so that the pressure between roll 2 and the support web is as uniform as possible over the total contact area.

FIG. 3C shows the beginning of the final winding phase. The load of roll 2 and of rider roll 6, if applied, is taken up by winder drum 4 and the entire portion 26 of support web 11 between support roll nips 24 and 25. When the winding is about to be completed, the angle 41 between reference plane 14 and the plane defined by the shafts of drums 10 and 10*a* is preferably between 0° . . . 45°, and the angle 42 between reference plane 14 and a horizontal line is 10° . . . 20°.

FIG. 4A shows a conventional support drum arrangement. The entire support load of a support drum is transmitted in the form of a load peak 29 at the support nip 29*a* to a supported paper roll 2. This easily causes damage in roll 2, in particular, if the total weight of the roll exceeds 1.5 tons/meter.

FIG. 4B visualizes a support according to the invention. Support web 11 follows the surface of roll 2, starting from nip 24 to nip 25. This means that the tension in support web 11 is not the best possible. Even if web portion 26 supports a main portion of the total load as indicated at 30*b*, load peaks 30, 30*a* occur at nips 24 and 25. However, these peaks are very much smaller than the load peak in FIG. 4A and in most cases not even 50% of what they would be, if there were no support web 11 or no tension in the support web 11. Hence, the surface pressure acting on roll 2 is easily maintained within a tolerable range. The arrangement shown in FIG. 4B is suitable for strong paper webs having a relatively low compressibility.

FIG. 4C visualizes what is considered to be the most favourable embodiment of the invention. Compared to the situation shown in FIG. 4B the tension of support web 11 is increased so that more of the support is provided by web portion 26 and less by nips 24 and 25. The tension of support web 11, the relative position of drums 4, 10, 10*a* and the load of rider roll 6 are so controlled in relation to the increase of weight and diameter in roll 2, that when the diameter of roll 2 exceeds 500 mm, the load 31 is kept as uniform as possible. The load variations within the support area should be maximum ±25%, preferably less than ±10%. The pressure distribution might vary somewhat in the transverse direction of web 1 depending on profile variations in the paper web, variations in roll diameter, etc.

FIGS. 4B and 4C have been simplified so that the load distribution is symmetrical. Unsymmetrical load distribution does not change the general principles of the invention.

Instead of the tension registering arrangement 37,38 of the support web 11, the tension can be measured and adjusted, for instance, on the basis of the diameter of the paper roll. Further, the load distribution visualized in FIG. 4C can also be realized in a situation corresponding to FIG. 3B. The tension of support web 11 is then so adjusted, that the support force is reduced at nip 24. A further embodiment of the invention is, for instance, an arrangement, in which winder drum 4 is replaced by a support arrangement corresponding to support web device 8. Then roll 2 receives a double-sided belt support. For the guidance of support web 11 one may apply barrel-shaped drums, guide collars or cylinders commonly used for paper machine wires and felts.

The invention is not limited to the embodiments disclosed, but several modifications thereof are feasible within the scope of the attached claims.

We claim:

1. A winder device for winding a moving web, such as paper or cardboard web, to form a roll of considerable weight, said roll being carried by support members giving said roll peripheral support, said support members comprising a movable support belt device and a rotatable winder drum which is spaced from the support belt device about the periphery of the roll, said support members being arranged to form the main support of said roll, said support belt device including a support belt having a portion between two rotatable support elements, which support belt portion has a surface of contact with said roll giving said roll support, said surface of contact being arranged to be continuously enlarged when said roll grows, in order to eliminate the risk of roll damage due to excess support pressure when winding heavy rolls, the web being conducted to the roll about the periphery of the winder drum and through the space between the winder drum and the support belt device.

2. A winder device according to claim 1, in which there is a rider roll element arranged to urge said roll against said winder drum.

3. A winder device according to claim 1, in which the support belt device includes an endless support belt arranged to run over rotatable drums of which at least one is provided with means for adjusting the belt tension and at least one is vertically adjustable relative to said winder drum in order to adjust the belt support of said roll.

4. A winder device according to claim 1, in which there is a first support drum close to said winder drum and a second support drum more remote from said winder drum, said second support drum being provided with means for adjusting its position vertically for controlling the support load distribution between said winder drum, said first support drum and said second support drum.

5. A winder device according to claim 4, in which the diameter of said winder drum is 1.5 . . . 3.5 times the diameter of said support drums.

6. A winder device for winding a moving web, such as a paper or cardboard web, to form a roll, comprising support means for supporting the roll at its periphery and providing the main support for the roll, said support means comprising winder means and a support belt device, said winder means having a peripheral surface and being spaced from the support belt device about the periphery of the roll, and said support belt device comprising at least first and second rotatable support elements and a support belt which is trained about the rotatable support elements and has a portion between the support elements for providing a surface of contact with the roll, there being means for increasing the peripheral extent of the surface of contact provided by the support belt as the diameter of the roll increases, the web being conducted to the roll about the peripheral surface of the winder means and through the space between the winder means and the support belt device.

7. A winder device according to claim 6, comprising a rider member for urging the roll against the winder means.

8. A winder device according to claim 6, wherein the winder means comprise a winder drum.

9. A winder device according to claim 6, in which the support belt device is arranged to urge the roll against the winder means during an early stage of the winding.

10. A winder device according to claim 6, wherein the rotatable support elements are rotatable drums and the support belt is an endless belt which runs over the rotatable drums, at least one of the rotatable drums being provided with means for adjusting the tension of the endless support belt.

11. A winder device according to claim 10, wherein the rotatable drums are disposed substantially horizontally and at least one of the rotatable drums is adjustable in a vertical direction relative to the winder means in order to adjust the support provided for the roll by the support belt device.

12. A winder device according to claim 6, wherein the first and second rotatable support elements are disposed substantially horizontally and comprise a first support drum which is close to the winder means and a second support drum which is more remote from the winder means, the winder device comprising means for adjusting the position of the second support drum in a vertical direction for controlling the distribution of support load between the winder means, the first support drum and the second support drum.

13. A winder device according to claim 12, wherein the winder means comprise a winder drum and the diameter of the winder drum is in the range from about 1.5 to 3.5 times the diameter of the first and second support drums.

14. A winder device according to claim 6, wherein the winder means comprise a winder drum which is disposed substantially horizontally and the first and second rotatable support elements are disposed substantially horizontally with the first rotatable support element closer than the second rotatable support element to the winder drum.

15. A method of winding a moving web, such as a paper or cardboard web, to form a roll, the roll being supported at its periphery by support means which provide the main support for the roll and comprise winder means and a support belt device, said winder means having a peripheral surface and being spaced from the support belt device about the periphery of the roll, and said support belt device comprising at least first and second rotatable support elements and a support belt which is trained about the rotatable support elements and has a portion between the support elements for providing a surface of contact with the roll, said method comprising rotating the roll by the winder means and conducting the web to the roll about the peripheral surface of the winder means and through the space between the winder means and the support belt device, so that the diameter of the roll progressively increases, and increasing the peripheral extent of the surface of contact provided by the support belt as the diameter of the roll increases.

16. A method according to claim 15, comprising employing a horizontally-disposed winder drum as the winder means and supporting the roll at a level such that its underside is close to or above a horizontal plane passing through the center of the winder drum.

17. A method according to claim 15, wherein the first and second rotatable support elements are horizontally-disposed rotatable drums and the support belt is an endless belt that runs over the rotatable drums, and the method comprises selectively adjusting the vertical position of one of the rotatable drums relative to the winder means in order to adjust the support provided to the roll by the support belt device.

18. A method according to claim 15, comprising increasing the tension of the portion of the support belt between the rotatable support elements in order to increase the supporting force provided for the roll by said portion of the support belt so that the contact pressure between the roll and the rotatable support elements is decreased to a value that is less than half that it was prior to increasing the tension in said portion of the support belt.

19. A method according to claim 15, comprising adjusting the tension in the portion of the support belt between the rotatable support elements so that the maximum difference between the average value of the support pressure over the surface of contact provided by the support belt and the value of the support pressure at a point of the surface of contact is less than 25% of the average value of the support pressure.

20. A method according to claim 15, comprising adjusting the support belt device to take up at least 50% of the total support load.

21. A winder device according to claim 14, wherein the relative vertical positions of the winder drum and at least one of the first and second rotatable support elements are adjustable.

22. A winder device according to claim 14, comprising a frame which supports the rotatable support elements, and wherein the second rotatable support element is movable downwards relative to the first rotatable support element for increasing the peripheral extent of the surface of contact provided by the support belt, and the device comprises means effective between the frame and the second rotatable support element for resisting downward movement of the second rotatable support element relative to the first rotatable support element.

23. A winder device according to claim 22, wherein the support belt device further comprises a third rotatable support element which is disposed horizontally and about which the support belt is trained, the third rotatable support element being below the second rotatable support element and being movable relative thereto, and the support belt device further comprises means for urging the second and third rotatable support elements apart for maintaining the support belt under tension.

* * * * *